United States Patent [19]

Dunn

[11] Patent Number: 5,068,941

[45] Date of Patent: Dec. 3, 1991

[54] FINGER-MOUNTED TOOTHBRUSH

[76] Inventor: Gary D. Dunn, P.O. Box 1115, Palm Harbor, Fla. 34582

[21] Appl. No.: 380,049

[22] Filed: Jul. 14, 1989

[51] Int. Cl.[5] ..... A46B 5/04

[52] U.S. Cl. ..... 15/167.1; 15/227; 206/362.2; 206/362.4

[58] Field of Search ..... 15/104.94, 167.1, 227; 206/209, 213, 362.2, 362.4, 440, 441, 529, 361; 2/21

[56] References Cited

U.S. PATENT DOCUMENTS

| | | | |
|---|---|---|---|
| 1,896,941 | 2/1933 | Cohen | 15/227 |
| 2,179,614 | 11/1939 | Cohen | 15/227 |
| 2,348,773 | 5/1944 | Wyman | 2/21 |
| 2,419,896 | 4/1947 | Hobelmann | 15/227 |
| 2,474,535 | 6/1949 | Krannak | 15/227 |
| 2,621,784 | 12/1952 | Boytham | 15/227 |
| 3,298,507 | 1/1967 | Micciche | 15/167.1 |
| 3,368,668 | 2/1968 | Micciche | 15/227 |
| 3,608,708 | 9/1971 | Storandt | 15/227 |
| 4,134,172 | 1/1979 | Arce | 15/227 |
| 4,602,650 | 7/1986 | Pipkin | 15/176.1 |
| 4,788,733 | 12/1988 | Lerner | 15/227 |

FOREIGN PATENT DOCUMENTS

| | | | |
|---|---|---|---|
| 3517094 | 11/1986 | Fed. Rep. of Germany | 15/227 |
| 1260031 | 1/1972 | United Kingdom | 15/227 |
| 2144032 | 2/1985 | United Kingdom | 15/227 |

*Primary Examiner*—Philip R. Coe
*Assistant Examiner*—Mark Spisich
*Attorney, Agent, or Firm*—Joseph C. Mason, Jr.; Ronald E. Smith

[57] ABSTRACT

A handleless toothbrush formed of an elastomeric material. The toothbrush, in a first embodiment, axially receives the distal end of a finger and has an opening that registers with a fingernail when the brush is worn properly. In a second embodiment, the brush axially receives the entire extent of a finger when fully deployed. Prior to deployment, the toothbrush is in the form of a bag member that has been turned partially inside out so that the bottom part of the bag member is encased within its folded back upper part so that the outside surfaces of both the bottom and the top parts are maintained in a substantially sterile condition. A third embodiment adds additional reverse folds and an adhesive strip covered by said folds that maintains the brush against slippage.

2 Claims, 3 Drawing Sheets

FINGER-MOUNTED TOOTHBRUSH

TECHNICAL FIELD

This invention relates, generally, to toothbrushes. More particularly, it relates to a handleless toothbrush that is worn on a finger.

BACKGROUND ART

Although dentists have long recommended that teeth should be brushed after every meal, following such recommendation is often not convenient for most people. Commercially available toothbrushes are elongate, rigid articles and as such are not conveniently carried in one's pocket. Moreover, conventional toothpaste tubes are also quite large, bulky and inconvenient to carry around. As a result, most people who work for a living do not brush their teeth after the noon meal simply because they do not have a toothbrush or a tube of toothpaste with them at their place of business.

Similarily, passengers on airplanes or other modes of public transportation often fail to brush after meals for the same reason. Even school children are not equipped to brush after lunch.

Several inventors have noted the deficiencies of the conventional toothbrush, and have developed alternative devices. Some of the inventive devices such as those shown in U.S. Pat. Nos. 2,419,896 to Hobelmann and 2,966,691 to Cameron are provided with toothpaste or other suitable dentifrice pre-applied to the bristles of the brush. These devices thus eliminate the need to carry a separate tube of toothpaste with the toothbrush.

U.S. Pat. No. 4,620,528 to Arraval, U.S. Pat. No. 4,665,901 to Spector and U.S. Pat. No. 4,608,986 to Rosofsky are other U.S. patents showing therapeutic agents.

Other U.S. patents of interest include U.S. Pat. No. 1,168,998, to Bradenburg, U.S. Pat. No. 3,905,113 to Jacob, U.S. Pat. No. 2,527,931 to Iskoe, U.S. Pat. No. 2,649,959 to Hallahan, U.S. Pat. No. 4,530,129 to Labick and U.S. Pat. No. 4,387,804 to Austin. Foreign patents of interest include U.K. 324,237, France 320,120, France 575,672 and U.K. 398,919.

Importantly, none of the earlier devices provide a small, flexible, handleless toothbrush that can be carried in a pocket, a billfold, a purse, or other container and still be in sterile condition when used.

DISCLOSURE OF INVENTION

The novel toothbrushes disclosed herein are made of a thin, elastomeric material.

The present invention, in a first embodiment, is a sleeve like member having a closed end and an open end; the inside diameter of the open end of the sleeve member is slightly less than the outside diameter of an index finger. The longitudinal extent of the sleeve member is about equal to the longitudinal extent of that part of the index finger distal to the distal interphalangeal joint.

Plural bundles of short, flexible bristle members are fixedly secured to the forward, bottom and sides of the sleeve member; the top of the sleeve member is bristle free.

A material savings opening having the width and extent of a fingernail is formed in the top of the sleeve member. The opening provides increased flexibility and also provides a template means that indicates when the device is properly worn, i.e., the fingernail is in registration with the opening when the device is properly worn.

A suitable dentifrice is applied to the bristles at the manufacturing facility that makes the novel fingerbrushes, and at least one of the novel items, in a knocked down flat configuration, is sealed in an easy open sterile bag. At least one paper cup means for mouth rinsing is also positioned in the sterile bag in its knocked down flat configuration as well. Accordingly, a single sterile bag may contain a half dozen or so fingerbrushes and cups so that a consumer, in one purchase, will have a supply of easy to carry toothbrushes and mouth rinsing means.

The device is used by axially inserting the end of a finger thereinto and by brushing in dentist-recommended ways. The opening formed in the top of the sleeve member frames the fingernail when the finger brush is worn as mentioned earlier.

In a second embodiment, the longitudinal extent of the toothbrush is substantially equal to the longitudinal extent of a finger and has the general appearance of an elongate flexible bag means when in use. Importantly, before the device is used, it is stored in a unique folded configuration whereby it is turned partially inside out; a reverse fold is formed substantially mid-length of the device so that the outer side walls of a proximal end of the toothbrush (the part near the base of the finger when the toothbrush is in use) overlies the outer side walls of the distal half of the brush when the bag means is reversely folded about mid-way along its extent. The open end of the bag means is releasably closed to maintain the outer side walls of the distal and proximal end of the toothbrush in a sterile condition.

In a third embodiment, an additional pair of reverse folds are added contiguous to the first reverse fold, to form an accordion-like configuration. A light adhesive is applied between the first and third folds and is protected thereby until the device is unfolded. When unfolded, the adhesive adheres the device to the finger inserted therein.

It is therefore clear that an important object of this invention is to advance the art of toothbrushes by providing a small, handleless toothbrush of unique design that can be carried in pockets or purses.

Another very important object is to provide a flexible toothbrush that forms its own carrying case when folded so that the operative part of the toothbrush is sterile when the toothbrush is unfolded for use.

The invention accordingly comprises the features of construction, combination of elements and arrangement of parts that will be exemplified in the construction set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which:

FIG. 11 is a side view showing how the second embodiment of the invention is put on;

FIG. 13 is a side elevational view of the third embodiment showing how it is put on.

Similar reference numerals refer to similar parts throughout the several views of the drawings.

BEST MODES FOR CARRYING OUT THE INVENTION

Figure 1:
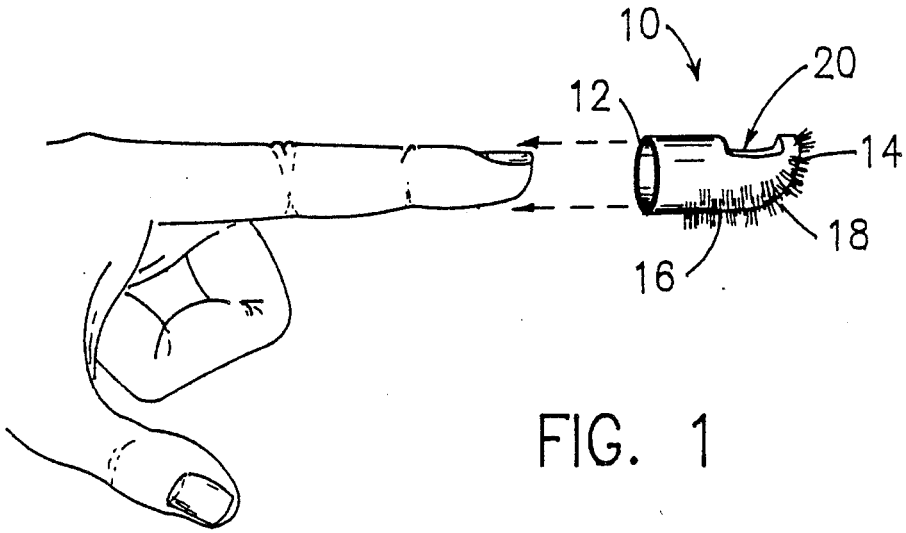
FIG. 1 is a side view of the first embodiment of this invention.
Figure 2:
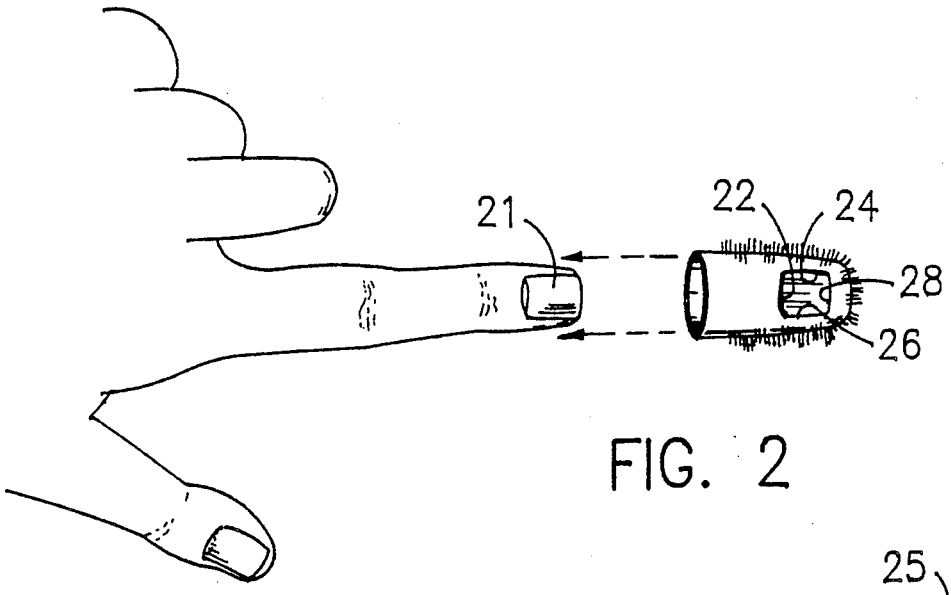
FIG. 2 is a plan view thereof.
Figure 3:
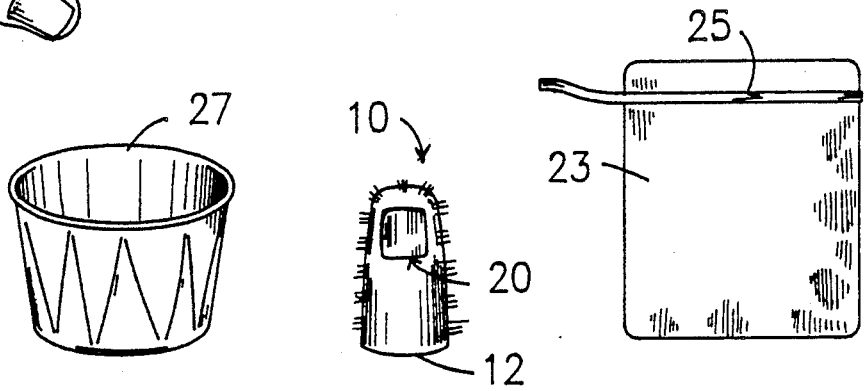
FIG. 3 shows the cup used for mouth rinsing in perspective, and further shows the first embodiment and a container means in elevation.
Figure 4:
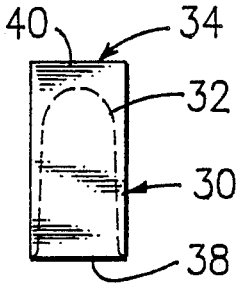
FIG. 4 is a top plan view of a first embodiment in its folded configuration.
Figure 5:
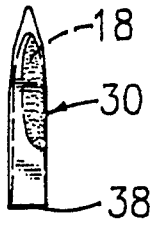
FIG. 5 is a side elevational view of the first embodiment in its folded configuration.
Figure 6:
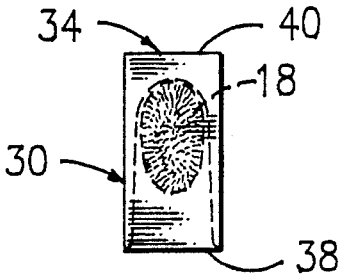
FIG. 6 is a bottom plan view of the first embodiment in its folded configuration.
Figure 7:
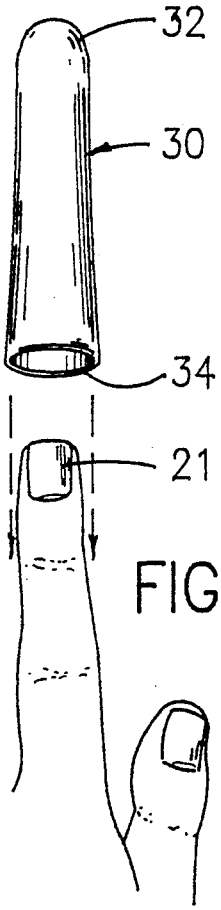
FIG. 7 is a top perspective view of the first embodiment in its unfolded configuration.
Figure 8:
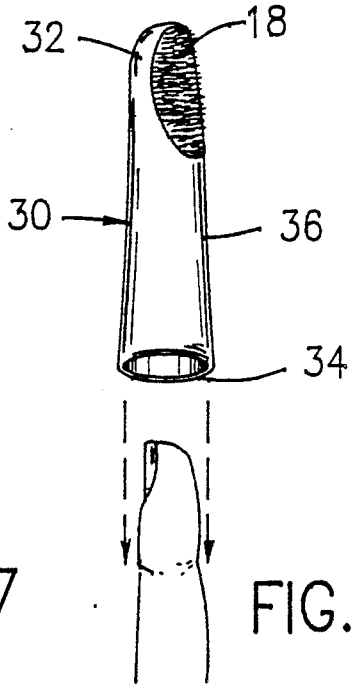
FIG. 8 is a side perspective view of the first embodiment in its unfolded configuration.
Figure 9:
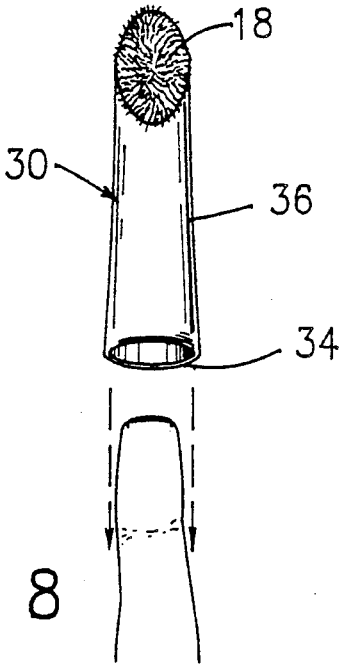
FIG. 9 is a bottom perspective view of the first embodiment in its unfolded configuration.
Figure 10:
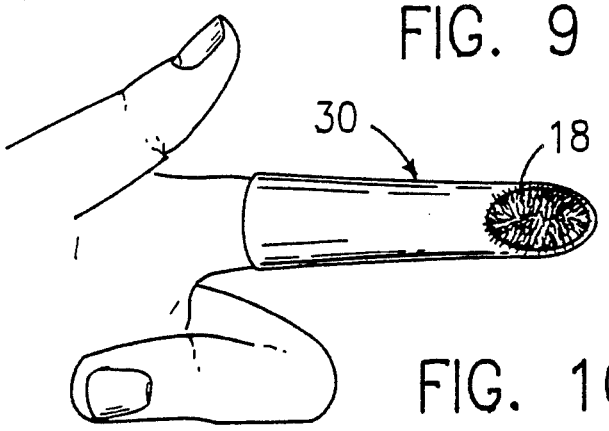
FIG. 10 is a bottom perspective view showing the first embodiment of the invention positioned on a finger.
Figure 11:
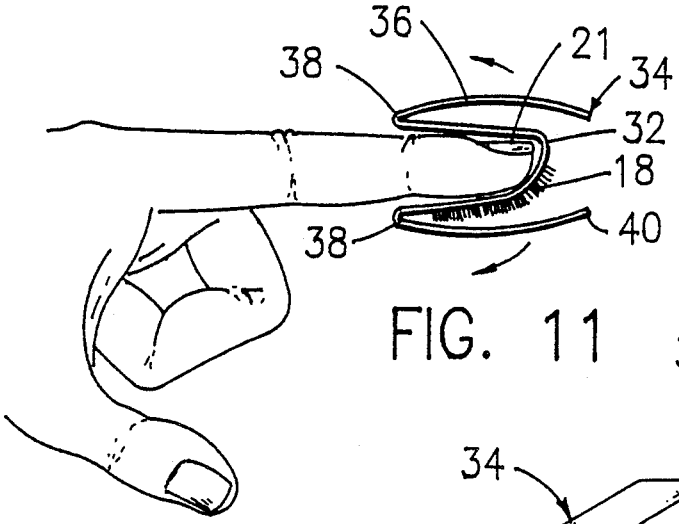

Referring now to FIGS. 1–3 it will there be seen that a first illustrative embodiment of the invention is denoted by the reference numeral 10 as a whole.

Toothbrush 10 has a generally tubular or sleeve-like structure as shown, although it has a closed end and is therefore not truly tubular in configuration.

More particularly, toothbrush 10 has an open or proximal end 12 of predetermined diameter, a closed or distal end 14 that conforms to the contour of a human finger, and a cylindrical medial part 16 therebetween.

Bundles of short, flexible bristle members, collectively denoted 18, are mounted in upstanding relation to the forward end, sides, and bottom of the brush 10 as shown. Alternatively, other non-bristle brushing means could be employed.

An aperture means 20 is formed near distal end 14; more specifically, as shown in FIG. 2, the aperture means 20 includes a circumferentially extending peripheral border 22 that is normal to the longitudinal axis of symmetry of brush 10, a pair of transversely spaced, longitudinally extending, parallel peripheral borders 24, 26 and an arcuate border 28. Thus, the aperture means has substantially the width and extent of a fingernail; when the brush is worn properly, the entire fingernail 21 of the selected finger is visible through said aperture means. Thus, the aperture 20 forms a template or guide means that insures that the user of the brush 10 will wear it properly. A simple instruction such as "align opening with fingernail" will advise the consumer of this important feature.

Opening 20 also saves materials and, perhaps more importantly, provides increased expandability to the structure.

FIG. 3 shows a bag member 23 having releasable sealing means 25; a plurality of flexible paper cups 27 and finger brushes 10 may be carried by the consumer in bag 23 so that the teeth can be brushed and the mouth can be rinsed a plurality of times during an extended trip, e.g.

A second embodiment of the invention is shown in FIGS. 4–12. In this embodiment, the toothbrush is provided in the form of an elongate thin flexible but not resilient bag 30, formed of elastomeric materials, having a longitudinal extent substantially equal to the longitudinal extent of a human finger as perhaps best shown in FIG. 10. As in the first embodiment, a plurality of truncate bristle members 18 are fixedly secured in upstanding relation to the distal end 32 of the device 30. Due to the non-resilient structure of bag number 30, the toothbrush remains in its seat, stored configuration when not in use.

The device 30 includes closed distal end 32, the inner side walls of which conform to the distal end of a human finger, an open proximal end 34 and an elongate cylindrical medial part 36 having cylindrical side walls as shown. A single annular reverse fold or return bend 38 (FIGS. 11 and 12) is formed about mid-length of the medial part 36 so that the outer side walls of the proximal part of the device overlie the outer side walls of the distal part, i.e., the device is turned partially inside out as depicted in FIG. 12 at the place of manufacture so that it is sold to consumers in its partially inside out configuration.

Thus, the distal end 32 of the device 30 is completely encased when the device is so folded as shown in FIGS. 4–6, 11 and 12.

Figure 12:
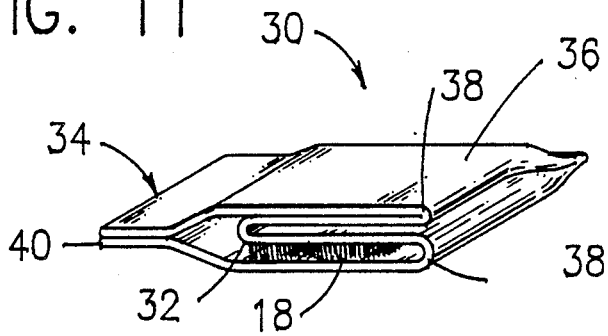
FIG. 12 is a longitudinal sectional view of the second embodiment in its folded configuration.

A releasable closure means 40 is formed at the rim of the open proximal end 34 of the device and when closed insures that the device will remain in its folded configuration until closure means 40 is opened as perhaps best understood in connection with FIG. 12.

It is critical to observe that when the fingerbrush is so folded, bristles 18 and the outer surface of the brush are completely inaccessable to dust, dirt or other debris. Accordingly, when the fingerbrush is used in the manner hereinafter set forth, the bristles and outer surfaces of the brush will be perfectly clean regardless of the length of time the brush may have occupied a storage shelf prior to its purchase, and regardless of the length of time the brush may have been stored in a pocket, purse, or other storage means. Preferably, the fingerbrush is sterilized prior to folding; accordingly, the bristles remain in sterile condition until the device is unfolded.

Figure 13:
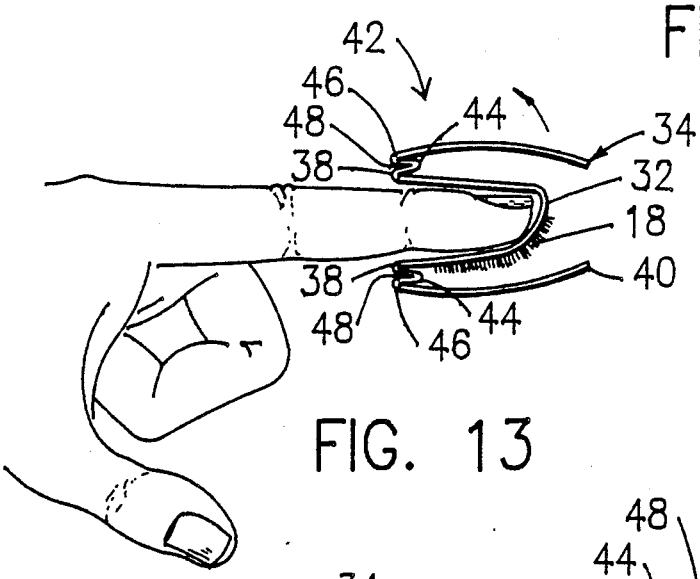
Figure 14:
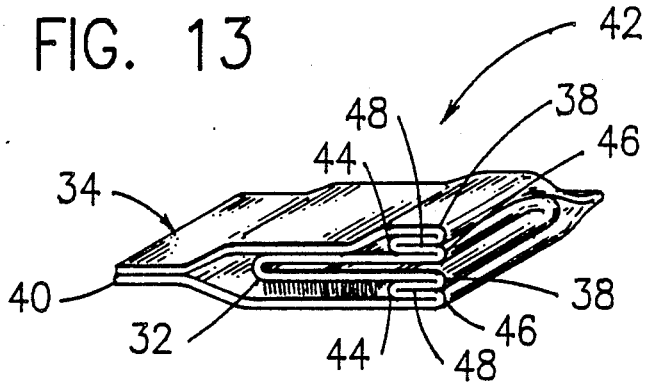
FIG. 14 is a longitudinal sectional view of the third embodiment in its folded configuration.

In a third embodiment, denoted 42 as a whole, shown in FIGS. 13 and 14, a total of three annular reverse bends 38, 44 and 46 are formed substantially mid-length of the bag means 42 so that the outer side walls of the proximal half of the device overlie the outer side walls of the distal half thereof.

The additional reverse folds 44 and 46 are provided to cover a light adhesive 48 disposed therebetween.

More particularly, a light adhesive of the type found in Post-It (tm) pads manufactured by 3M corporation is applied to an annular region of the inner side walls of the medial part of the brush between the first and last folds so that when folds 38, 44 and 46 are formed, the light adhesive is covered. Thus, when an individual using said brush places it on his or her finger as depicted in FIG. 13, opening closure means 40 and by bringing open end 34 to the base of the finger, the adhesive 48 will be uncovered and will lightly adhere to the individual's finger, about mid-length thereof. The adhesive will maintain the fingerbrush against slippage.

To accomplish the important objective of covering the bristles prior to sale to insure their sterility, only the first fold 38 is needed, i.e., the second and third reverse folds 44 and 46 could be eliminated and the outer proximal side walls of the brush would still overlie the outer distal side walls thereof as shown in FIG. 12.

Thus, whereas the first embodiment required a separate carrying case to maintain its germ-free condition, the fingerbrushes of the second and third embodiment provide their own germ-free carrying case when reversely folded.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also understood that the following claims are intended to cover all of the generic and specific features of the invention herein described, and all statements of the scope of the invention which, as a matter of language, might be said to fall therebetween.

Now that the invention has been described,

What is claimed is:

1. A flexible toothbrush, comprising:

an elongate flexible bag member having a closed distal end, an open proximal end, and a cylindrical medial part therebetween;

all of said parts being formed of a common thin material and said bag member being of unitary, one-piece construction;

said cylindrical medial part having a distal part and a proximal part;

a plurality of truncate bristle members secured in upstanding relation relative to preselected outer surfaces of said distal part of said cylindrical medial part;

closure means for releasably closing said proximal end;

said bag member, when unfolded and deployed into an operative configuration, having a longitudinal extent substantially equal to the longitudinal extent of a human finger;

said bag member, when unfolded and deployed into an operative configuration, having a diameter substantially equal to the diameter of a human finger;

said bag member being partially folded inside-out when in a stored condition, said folding resulting in the formation of a return bend;

said bag member being partially folded inside-out prior to use and said bag member being discarded after use when in its unfolded condition;

said open proximal end extending distally beyond said closed distal end only when said bag member is folded so that said distal end is covered and kept sterile when the bag member is stored;

said open proximal end being closed only when said bag member is folded;

said bristle members being covered by said proximal part of said cylindrical medial part only when said bag member is partially folded inside-out;

said bag member having a substantially flat configuration when in its stored condition;

said bag member being formed of a non-resilient material so that it remains in its flat configuration when stored;

whereby cleanliness of said bristle members is maintained until said closure means is released and said bag member is unfolded to expose said bristle members.

2. A flexible toothbrush, comprising:

a flexible bag member having a length substantially equal to the length of a human finger when said bag member is operatively deployed on a human finger;

said bag member having a diameter substantially equal to the diameter of a human finger when said bag member is operatively deployed on a human finger;

said bag member having an open proximal end, a closed distal end, and a substantially cylindrical medial part extending therebetween;

said bag member having an integral construction and being made of a single material;

said cylindrical medial part having a proximal part and a distal part;

a plurality of bristle members being secured to the distal part of said cylindrical medial part and being disposed in upstanding relation to said distal part of said cylindrical medial part;

said bag member being folded partially inside-out, said closed distal end and said distal part of said cylindrical medial part and bristle members secured thereto being covered by said proximal part of said cylindrical medial part only when said bag member is turned partially inside-out to thereby maintain the cleanliness of said bristle members when the bag member is in a stored condition;

said bag member being partially unfolded inside out only before the toothbrush is used, said toothbrush being discarded, after use, when in its unfolded condition;

means for releasably closing said open proximal end of said bag member;

said open proximal end being closed only when said bag member is folded;

said bag member having a flat configuration when folded;

said bag member being formed of a non-resilient material so that said bag member remains flat when in a stored configuration;

whereby said bristle members are kept clean as long as said bag member is folded and as long as said means for releasably closing said open proximal end remains closed;

whereby said bristle members are uncovered when said proximal end is opened and said bag member is unfolded; and whereby said toothbrush is used and discarded when in its unfolded condition, said toothbrush not being returned to its partially folded inside-out condition after use.

* * * * *